US006692110B2

(12) United States Patent
Sundström

(10) Patent No.: US 6,692,110 B2
(45) Date of Patent: Feb. 17, 2004

(54) DEVELOPING SYSTEM FOR BORE MATRIX

(75) Inventor: Per Sundström, Järfälla (SE)

(73) Assignee: Jarfalla Digital Filter Printer AB, Jarfalla (SE)

( * ) Notice: Subject to any disclaimer, the term of this patent is extended or adjusted under 35 U.S.C. 154(b) by 0 days.

(21) Appl. No.: 10/220,260

(22) PCT Filed: Jan. 26, 2001

(86) PCT No.: PCT/SE01/00156

§ 371 (c)(1),
(2), (4) Date: Nov. 5, 2002

(87) PCT Pub. No.: WO01/64447

PCT Pub. Date: Sep. 7, 2001

(65) Prior Publication Data

US 2003/0142171 A1 Jul. 31, 2003

(30) Foreign Application Priority Data

Mar. 3, 2000 (SE) ..... 0000717

(51) Int. Cl.[7] ..... B41J 2/06
(52) U.S. Cl. ..... 347/55

(58) Field of Search ..... 347/55, 151, 120, 347/141, 154, 103, 123, 111, 159, 127, 128, 131, 125, 158; 399/271, 290, 292, 293, 294

(56) References Cited

U.S. PATENT DOCUMENTS 5,404,159 A 4/1995 Ohashi

*Primary Examiner*—Raquel Yvette Gordon
(74) *Attorney, Agent, or Firm*—Larson & Taylor PLC

(57) ABSTRACT

A developing system for a bore matrix in a printer using toner in the form of a dry toner powder, and comprising a feeder brush (3) which receives toner from a toner container (1), a printer brush (5) receiving toner from the toner feeder brush (3) and transporting same through bores of a bore matrix (8) and down to a document (9) to be printed, and means (15) for charging the toner particles by mechanically rubbing the toner particles (2) against the printer brush (5), and in which a means (19) may be provided for ripping free the charged toner particles (2), so that said particles form a cloud (7) of charged toner particles (2) adjacent the bore matrix (8), which pass down to the document (9) to be printed through open bores of the bore matrix (8).

12 Claims, 3 Drawing Sheets

DEVELOPING SYSTEM FOR BORE MATRIX

The present invention generally relates to an apparatus comprising a "printer head for electronic printing" of the type which is shown and described in the Swedish patent Nr 9903000-9 (PCT/SE00/01622) having validity from Aug. 25, 1999, and which, in turn, is built on a method for printing on paper by means of toner and based on U.S. Pat. No. 3,689,935 (Pressman/Casanova).

By having toner, in the form of a dry ink powder, flow through several narrow bores of a bore matrix, which is arranged so that it is possible to open and close, alternatively, selected bores of said bore matrix. The toner powder is adapted to create meaningful signs. The bores of the bore matrix is controlled both by means of an electric field which is applied over the bore, which field closes and opens, respectively, each separate bore, and also by means of an electric main field that transports toner down from the bore to a paper located underneath the matrix when the bore is open. In order to have toner react on said two different electric fields, which are created round the bore, the toner particles must be electrically charged. The toner, which is normally available on the market, is formed so that it can be charged to a negative electric charge. Said charging is provided in that the toner particles are rubbed mechanically against a material having such properties as to charge the toner to a negative potential.

The above mentioned Swedish patent (=PCT application) describes a method for creating a main field from a metal layer, which is located on the upper surface of the bore in the bore matrix, and down to a pulling electrode which is mounted underneath the matrix bore. The paper is positioned between the pulling electrode and the matrix bore, and the toner will deposit on said paper after having passed the bore. At the lower surface of the bore matrix there is an electrically conducting ring round each bore, which ring is connected to a relay circuit which can apply an electric potential round each separate bore. Thereby there is formed a field from the upper surface of the bore to the lower surface thereof, which field can have the same direction as that of the main field, whereby the bore is "open" for passage of toner. If the field is applied in a direction which is opposite to the main field the bore will be "closed" for passage of toner.

The patent also discloses a method of creating a cloud of charged toner particles above the matrix bore, which cloud is floating (air suspended) and is in continuous movement in that toner is thrown out from a brush down towards the bore. The toner which is not used will either mechanically rebounce into the brush or will be pulled into the brush in case said brush has a positive electric potential.

DESCRIPTION OF PROBLEM

In the priorly known technical art the toner particles are transported from a toner container by means of a feeder brush down to a printer brush, where the toner is released using a rip off bar to form a cloud of toner particles which find their way to open bores of the bore matrix but which may also deposit on the upper surface of the bore matrix where they provide dots of non used toner particles which have to be removed in some way. If said toner is not removed the space between the brush and the bore matrix will be filled with toner and the entire printing process will cease. It may also happen that some toner particles, for various reasons, become charged to the wrong potential. Such wrongly charged toner particles may cause problems in that the bore matrix becomes dirtied at the bottom surface of the toner matrix and that the printed paper becomes dirty. It may be difficult to remove such wrongly charged toner particles.

THE INVENTION

The present invention is intended to solve the problems in the priorly known technical art and to suggest an alternative of how to transport toner from a toner container using a feeder brush down to a printer brush and further down through the bore matrix and as far as to the paper to be printed. According to the invention the toner particles are charged by being mechanically rubbed against the printer brush using charging ridges. The apparatus also includes means for removing toner particles which, for various reasons, have become wrongly charged by the printer brush, and means for forming a cloud of free toner particles which move inside the brush between the brush fibers, and whereby said brush finally keeps the metal layer above the bores of the bore matrix free from toner.

SHORT DESCRIPTION OF DRAWINGS

FIG. 1 diagrammatically and in a cross section view shows the course of events from the moment when toner is fed down from a toner container and moves towards the bore matrix.

FIG. 2 separately shows how toner particles are collected on the brush fibers of the printer brush.

FIG. 3 fragmentarily and in an enlarged scale shows how the feeder brush of the developing system rotates and rips down toner particles onto the printer brush.

Figure 9:
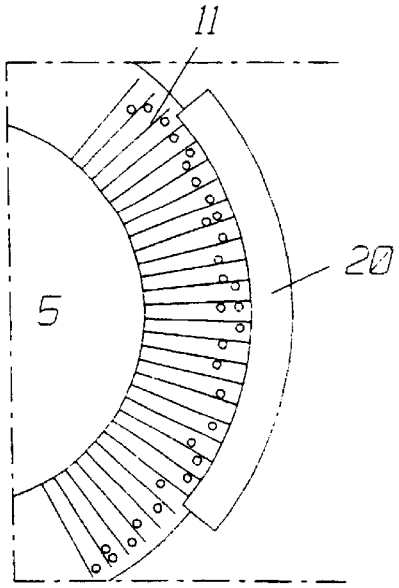

FIG. 9, finally, shows how the fibers of the printer brush are rubbed against a metal surface which is connected to an electric reference voltage and which discharges remaining toner particles and brush fibers.

DETAILED DESCRIPTION

Figure 1:
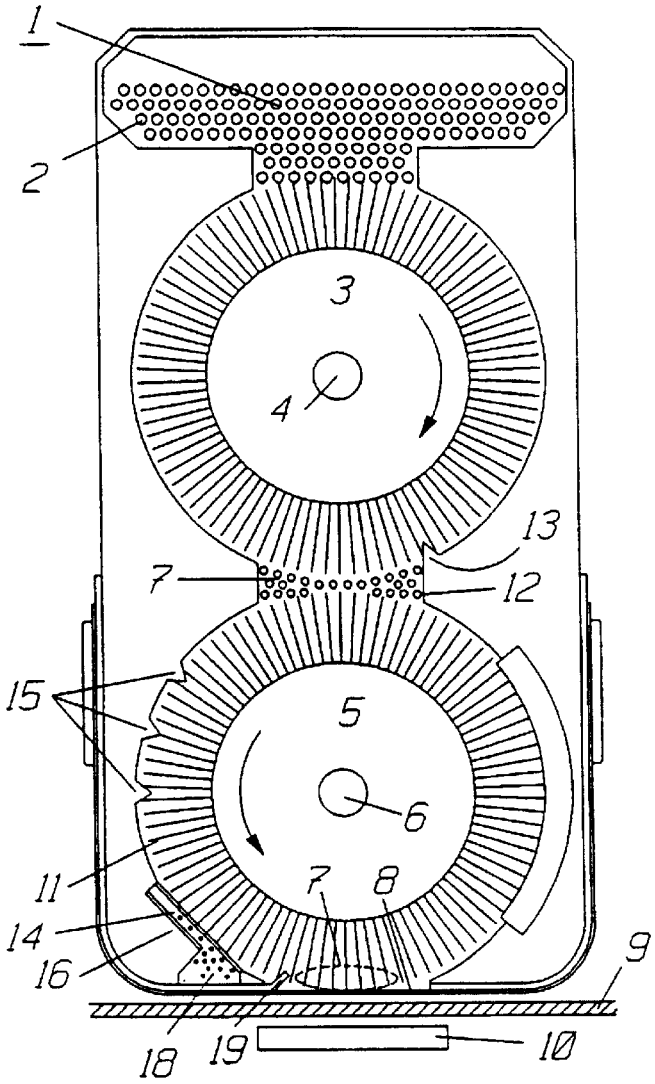

The developing apparatus according to the invention, shown in FIG. 1, generally comprises a toner container 1 mounted at the top of the apparatus, and which lets down toner particles 2 onto a feeder brush 3 which rotates about a shaft 4, and further onto a printer brush 5 which rotates about a shaft 6 that is parallel to the shaft 4 of the feeder brush 3, and whereby toner is brought to form a cloud 7 of toner particles. Toner particles are, from said toner cloud 7, sucked down through open bores of a bore matrix 8 and down onto a document 9 under the action of a pulling electrode 10 thereby forming desired signs while said document is moved past the bore matrix 8. The toner particles on the document 9 are fixed as known in the art by means of a pressure and heating means (not shown).

Each of the feeder brush 3 and the printer brush 5 are mounted on an electrically conducting shaft 4 and 6, respectively, and with the fibers of the brushes on a slight distance from each other. The feeder brush 3 rotates at a slightly less speed than the printer brush 5. For keeping the amount of toner in the printer brush 5 constant the feeder brush 3 rotates after a predetermined number of bores in the bore matrix have become opened and have let toner through. In an embodiment of the invention the printer brush 5 has a diameter of 15–20 mm, depending on the size of the printer unit, and the brush 5 rotates at a speed of 20–40 rpm considering the length and the stiffness of the fibers and considering the brush diameter. In order not to over-charge the brush and cause variations of the toner charging and the cloud formation etc. the brush fibers ought to be semi-resistive in the sense that the brush fibers are not insulated and also not electrically conducting. They also should have electric contact with the brush shaft, so that said shaft can slowly drain the electric charge to a reference voltage by means of a contact system. For the developing system according to the invention there is preferably used a mono-component toner, whereby is meant a toner not containing magnetite, since the toner does not make use of a rotating magnetic field for being moved forward to the printing area. Generally the base component of a mono-component toner comprises polyesther or a styrene acrylate, and in order to give said base component material a negative charge they ought to be rubbed against a material giving the toner particles a negative charge according to the tribo-electrical scale. Therefore the material of the brush fibers 11 must be selected according to said tribo-electrical scale so that the correct charging is obtained.

Figure 2:
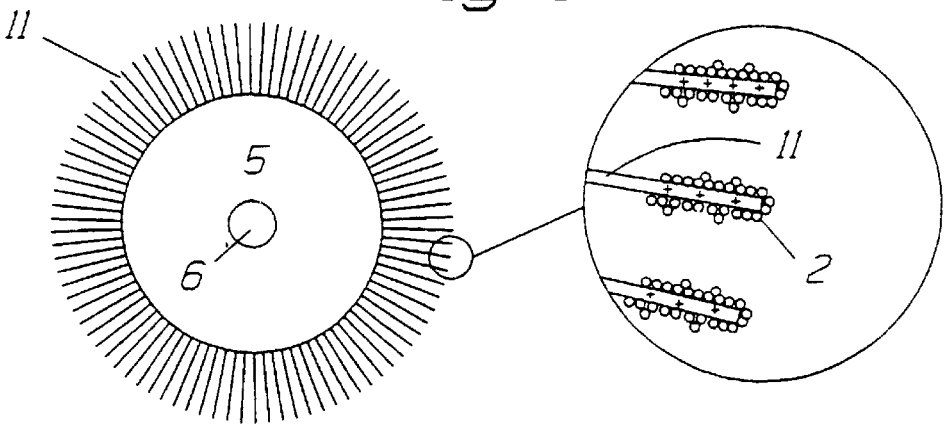

FIG. 2 shows a printer brush 5 for which a suitable material for the brush fibers 11 can be an amide plastic like Nylon®, a cellulose fiber material or another fiber material. The fibres ought to have a diameter of 30–50 $\mu$m and a length of 2.5 to 5 mm, depending on how close to each other the bores of the printer unit are located and what stiffness each fiber has. The stiffness should be adapted so that the oscillation frequency, when the fibers are brought into oscillation, creates a force which is sufficiently great for shaking off charged toner particles from the fibers. The tightness between the brush fibers should be so great that the amount of toner particles is sufficient as to create a printer point when each fiber is fully supplied with toner particles. In a bore matrix having for instance 300 bores per inch the brush can be formed with 20.000 to 40.000 brush fibers 11 per square centimetre peripheral surface.

Thus, the feeder brush 3 of the developing system rotates relatively slowly, and it only rotates upon need for ripping off the correct amount of toner to the printer brush 5 in order that said printer brush 5 should not get a too little amount of toner and a too lean mixture, or too much toner, what may have as a consequence that the brush 5 has not the capacity of charging all toner, and that said brush 5 finally becomes over-filled and the activity of the brush is ceased.

Figure 3:
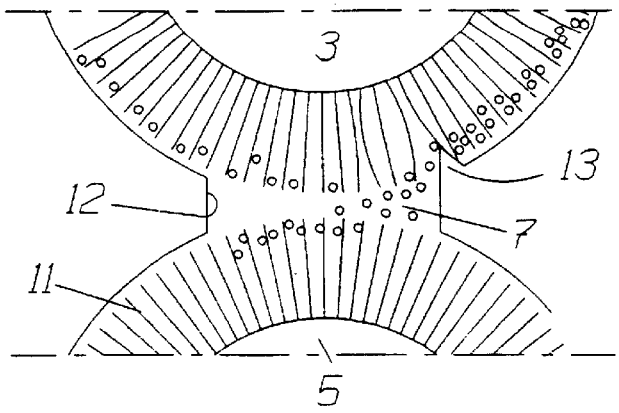

FIG. 3 shows that there is a rip off ridge 13 at the entrance of the toner channel 12 between the feeder brush 3 and the printer brush 5, which ridge 13, during the slow rotation of the feeder brush 3, bows the brush fibers 11, so that said fibers rip off toner particles from the feeder brush 3 thereby forming a cloud of toner particles which fall down onto the printer brush 5.

Figure 4:
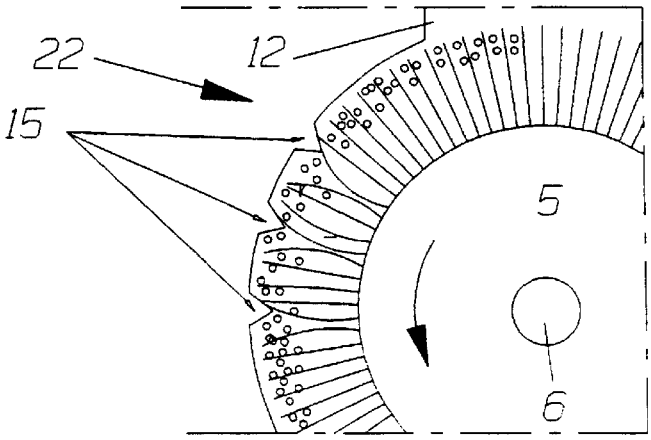
FIG. 4 illustrates how toner becomes charged when the printer brush is rotated past stationary charging ridges of the developing system.

The printer brush 5, which rotates in a direction which is opposite to that of the feeder brush 3 collects toner particles between the brush fibers. For charging the toner particles 2 the wall 22 adjacent the printer brush 5 is formed with several charge ridges 15 which put the brush fibers 11 into movement as illustrated in FIG. 4. This increases the stirring effect of the toner, and when the toner particles get into movement there is created a charging between the fibers 11 of the brush and the charge ridges and the toner particles 2 at each moment that a toner particle 2 meets a brush fiber 11 or a charge ridge 15. At a sufficient stirring activity each toner particle will be charged over the entire surface thereof and the toner can not receive further charging. If the toner concentration in the printer brush 5 is now the correct concentration each brush fiber 11 will have one or partly two layers of toner particles 2 round the fiber, and said toner particles stick to the brush fibers, as diagrammatically illustrated in the enlarged part view of FIG. 2, for the reason that the fiber 11 is positively charged and the toner particles are negatively charged.

There will, however, exist toner particles which have such qualities that parts of their surfaces will be positively charged, and such particles will immediately be attracted to a negatively charged toner particle and together therewith form a greater and less strongly charged particle. It may also happen that the wrongly, that is the positively, charged toner particle or combined toner particle will turn the positive sides of the particle surface opposite to the positive fiber, whereas the particle sticks to the fiber with the negative particle side. It is unsuitable for the developing process to have positively charged toner in the toner mixture, since the positively charged toner reacts oppositely in relation to negatively charged toner and will contribute to make the paper dirty and to make the area round the bores of the bore matrix 8 dirty, through which bores the toner is to be guided. Such dirtying of the bores of the bore matrix will by time reduce the possibility of the bores to effectively control the opening and the closing of the bores.

Figure 5:
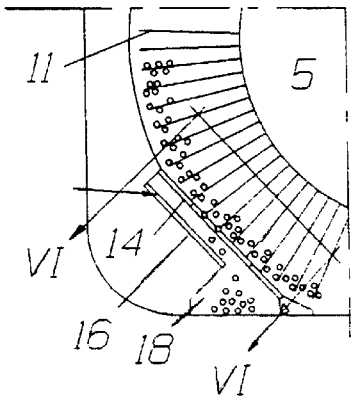
FIG. 5 illustrates an apparatus for diverting and removing toner particles having wrong charging.
Figure 6:
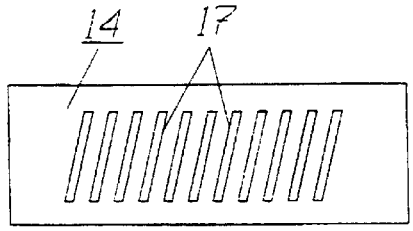
FIG. 6 shows, in an enlarged scale, a cross section view along line VI—VI of FIG. 5.

FIGS. 5 and 6 show a suggested way of removing positively charged toner particles. This is done using a grid 14 having a positive potential in relation to a grid electrode 16 mounted spaced from the grid 14 by about 0.5 to 1 mm. The grid 14 is formed with several thin threads/wires 17 which provide a field that is increased in strength the closer to the threads 17 that the toner particles come when applying a potential between said threads 17 and the grid electrode 16. The field between the grid 14 and the grid electrode 16 can be about 500 to 1.000 V/mm, but the field strength is increased round the grid threads 17 and has about 5 to 10 times higher strength very close to said thread/wire depending on the thread/wire diameter. Said high field causes a ripping off all toner particles which are positively charged or have a positive surface and send said particles to the grid electrode 16. Thereby there is obtained a separation of positively charged toner particles from negative particles which are to be used in the developing process. Toner particles which are caught on the grid electrode 16 fall down in a toner trap 18 underneath the grid electrode 16. Said toner trap 18 collects said non-desired toner in a waste container.

If the grid wires 17 are arranged slightly obliquely, as shown in FIG. 6, for instance the same obliquely as the space between two wires 17 all fibers 11 of the printer brush will be in contact with the strong field round a grid wire 17, and this guarantees that it is possible to reach all potentially positively charged toner particles of the printer brush 5.

Figure 7:
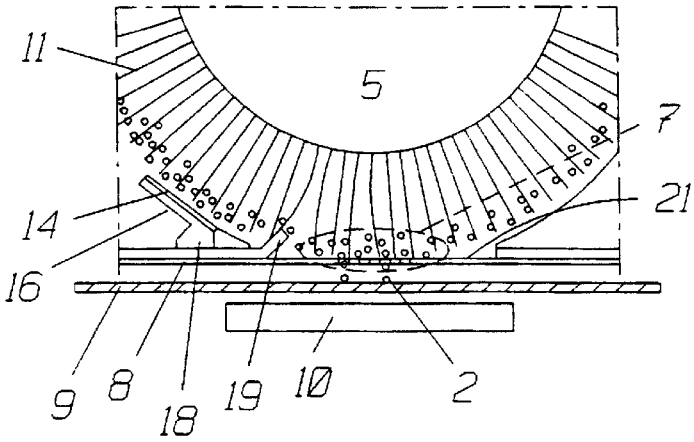
FIG. 7 shows how the printer brush, while rotating, passes a rip off bar which is mounted at a place in advance of the place where the brush fibers get into contact with the metal surface above the bores of the bore matrix.

FIG. 7 shows how the printer brush 5 has been further rotated and is now actuated on by a rip off bar 19 which is mounted, in the direction of rotation, in advance of the place where the brush fibers 11 get in contact with the metal layer 21 above the bores of the bore matrix 8. The rip off bar 19 rip the fibers 11 so that the negatively charged toner particles are released from the fibres 11 and flow about in a cloud 7 of toner particles. During said moment the toner particles and the fibres move past the bores of the bore matrix 8, and, if said bores are open, toner particles 2 will follow the lines of flux through the bores and further down to the document 9 to be printed which is located between the bore matrix 8 and the pulling electrode 10. The toner particles 2 are deposited on said document. If a bore is closed the field is oppositely directed and no toner can pass through the matrix bore. Since the fibers 11 of the printer brush 5 sweep over the upper metal layer 21 of the bore matrix 8 said brush fibers also will keep the metal layer free from non-desired toner that would otherwise successively stick to said surface.

Figure 8:
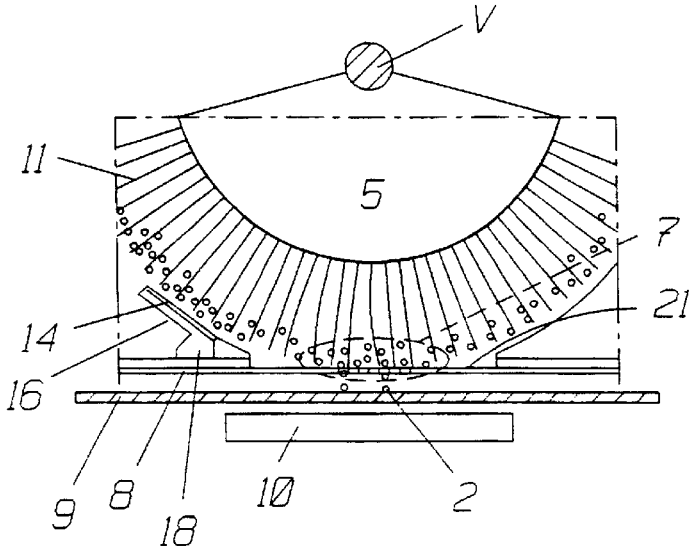
FIG. 8 shows an alternative embodiment, similar to that of FIG. 7, but not having a rip off bar, and in which embodiment it is possible to control the amount of toner particles which are fed down through the open bores of the bore matrix by applying a positive charge on the centre shaft of the printer brush.

FIG. 8 shows an alternative embodiment similar to that of FIG. 7 but not having a rip off bar. A voltage V is applied to the shaft 6 of the printer brush 5. Said voltage is set to such a level as to provide a field between the top of each brush fiber 11 of the printer brush 5 and the metal layer 21 at the top surface of the bore matrix 8, which field gives the correct retaining force and will let toner particles 2 through an open bore of the bore matrix 8.

After the toner particles have been released and have been sucked down through the bores of the bore matrix 8 and down onto the document 9 to be printed the fibers 11 of the printer brush 5 will rub against a metal surface 20 which is connected to a reference voltage, as shown in FIG. 9. At said contact between the brush fibers 11 and the metal surface 20 the positive charge of the fibers 11 will be drained, and there is obtained a discharging of the brush 5 so that said brush can not be overcharged. If the brush fibers 11 are of semi-resistive type there will be obtained a more even discharging of the entire printer brush 5, and this guarantees that the parts of the fibers 11 located more closely to the hub or the shaft 6 will not be overcharged.

REFERENCE NUMERALS

1 container
2 particles
3 feeder brush
4 shaft
5 printer brush
6 shaft
7 toner cloud
8 matrix
9 document
10 pulling electrode
11 fibers
12 channel
13 ridge
14 grid
15 charge ridge
16 grid electrode
17 grid wire
18 toner trap
19 rip off bar
20 metal surface
21 metal layer
22 wall

What is claimed is:

1. A developing system for a bore matrix in a printing apparatus, in which toner in the form of a dry powder is transported from a toner container down onto a document to be printed, and comprising a feeder brush which receives toner from the toner container and which transports said toner to a printer brush and further through bores of a bore matrix down onto the document to be printed, characterized in that the toner particles are being charged in that the toner particles are being mechanically rubbed against the printer brush using charging ridges arranged on a wall adjacent the printer brush, and further comprising means provided closely in advance of the bore matrix, as seen in the direction of rotation of the printer brush, for ripping free the charged toner particles by having the brush fibers naturally oscillate thereby providing a cloud of charged toner particles adjacent the bore matrix.

2. A developing systems according to claim 1, characterized in that said means for ripping free toner particles is a rip off bar extending inside the periphery of the printer brush fibers and which acts on said fibers when moving past said rip off bar.

3. A developing system according to claim 1, characterized in that said means for ripping free toner particles from the printer brush comprises a metal layer on top of the bore matrix which makes the brush fibers oscillate and whereby the shaft of said printer brush is connected to a voltage of such magnitude as to keep the toner particles attracted to the printer brush fibers until said fibers start oscillating, whereby the toner particles are let through an open bore of said bore matrix.

4. A developing system according to claim 1, characterized in that the printer brush is mounted at such distance from the bore matrix that the lowermost brush fibers sweep tangentially or nearly tangentially over the upper metal layer of the bore matrix.

5. A developing system according to claim 1, characterized in that the brush fibers are of a material which is semi-resistive, so that the charged toner particles are attracted, easily releasable, to the printer brush fibers and, after having passed said means for ripping toner particles free, provide a cloud of negatively charged toner particles inside the printer brush, between the printer brush fibers, which particles can be transported down through electrically opened bores of the bore matrix and down onto the document to be printed, whereas other toner particles are moved on by the printer brush.

6. A developing system according to claim 1, characterized in that it comprises several charging ridges provided on the wall extending along the periphery of the printer brush for making the brush fibers oscillate thereby making the toner particles bounce to and from different fibers thereby, assisted by the tribo-electrical effect, becoming charged to a negative charge, while the fibers of the printer brush get a positive charge.

7. A developing system according to claim 1, characterized in that it comprises means mounted in the rotational direction of the printer brush in advance of the place where toner particles are let down on the bore matrix and adapted to remove toner particles which, for various reasons, have been wrongly charged by the printer brush.

8. A developing system according to claim 7, characterized in that the means for removing wrongly charged toner particles comprises a grid mounted tangentially in relation to the printer brush and having grid wires arranged slightly spaced from each other and between which wrongly charged toner particles can be let down in a toner particle collecting trap.

9. A developing system according to claim 1, characterized in that the fibers of the feeder brush, and the printer brush are of such length/diameter and stiffness that they get into natural vibration when the fibers move past a rip off ridge, whereby said natural vibrations provide a movement of the toner particles so that said particles become released from the fibres and become charged or provide a cloud of toner, alternatively, for more easily being transferred down through the bores which are open in the bore matrix.

10. A developing system according to claim 1, in which the brush fibers are semi-resistive, characterized in that the system comprises, in the rotational direction of the printer brash, subsequent to the bore matrix, a metal surface which is connected to a reference voltage and is adapted to drain the (positive) charge of the printer brush at contact with the fibers of said printer brush.

11. A developing system according to claim 1, characterized in that the feeder brush is arranged to rotate at lower speed than the printer brush, and in that the feeder brush is rotated only under short time intervals for transferring toner to the printer brush.

12. A developing system according to claim 1, characterized in that both the feeder brush and the printer brush are formed with shafts of metal, which are connected to a certain reference voltage for making it possible to drain charges from the brushes.

* * * * *